US009726200B2

(12) United States Patent
Zmuda et al.

(10) Patent No.: US 9,726,200 B2
(45) Date of Patent: Aug. 8, 2017

(54) MODULAR EJECTOR PUMP FOR A FUEL DELIVERY DEVICE

(71) Applicant: Robert Bosch GmbH, Stuttgart (DE)

(72) Inventors: Slavomir Zmuda, Ceske Budejovece (CZ); Vitezslav Prochazka, Srubec (CZ); Radek Malec, Ceske Budejovice (CZ); Petr Janis, Adamov (CZ); Miroslav Pecha, Veseli nad Luznici (CZ)

(73) Assignee: Robert Bosch GmbH, Stuttgart (DE)

( * ) Notice: Subject to any disclaimer, the term of this patent is extended or adjusted under 35 U.S.C. 154(b) by 386 days.

(21) Appl. No.: 13/936,692

(22) Filed: Jul. 8, 2013

(65) Prior Publication Data

US 2014/0010677 A1 Jan. 9, 2014

(30) Foreign Application Priority Data

Jul. 6, 2012 (DE) ..... 10 2012 211 847

(51) Int. Cl.
*F04F 5/46* (2006.01)

(52) U.S. Cl.
CPC ..... *F04F 5/466* (2013.01); *Y10T 29/49236* (2015.01)

(58) Field of Classification Search
CPC ..... F04F 5/44; F04F 5/46; F04F 5/54; F04F 5/466; F04F 5/467; F04F 5/00; F04F 5/02; F04F 5/10; F04F 5/12; Y10T 29/49236
See application file for complete search history.

(56) References Cited

U.S. PATENT DOCUMENTS 632,481 A * 9/1899 Trix ..... 417/166
5,396,872 A * 3/1995 Ruger ..... B60K 15/077 123/514
6,210,123 B1 * 4/2001 Wittrisch ..... 417/194
2002/0083983 A1 * 7/2002 Coha et al. ..... 137/565.22
2005/0279414 A1 * 12/2005 Kleppner et al. ..... 137/565.22
2008/0302339 A1 * 12/2008 Krogull et al. ..... 123/516
2010/0037866 A1 * 2/2010 Tipton et al. ..... 123/509
2010/0202898 A1 * 8/2010 Mason et al. ..... 417/151
2011/0250079 A1 * 10/2011 Kim ..... F02M 37/025 417/198

FOREIGN PATENT DOCUMENTS

DE 102004022564 12/2005

* cited by examiner

*Primary Examiner* — William H Rodriguez
*Assistant Examiner* — Charles Nichols
(74) *Attorney, Agent, or Firm* — Michael Best & Friedrich LLP

(57) ABSTRACT

A modular ejector pump (1) for a fuel delivery device (39). The ejector pump (1) has a feed line (3) and a first nozzle (7). The feed line (3) is embodied to supply fuel (27) to the first nozzle (7). The ejector pump (1) furthermore has a second nozzle (9), which is arranged parallel to the first nozzle (7). The feed line (3) is embodied to supply fuel (27) to the second nozzle (9).

14 Claims, 5 Drawing Sheets

MODULAR EJECTOR PUMP FOR A FUEL DELIVERY DEVICE

BACKGROUND OF THE INVENTION

When the filling level in a fuel tank is low, it is not possible to ensure the fuel supply to a combustion engine at different angles of inclination, e.g. on bends.

In order to be able to ensure a fuel supply to the combustion engine, even when the filling level is low, fuel delivery devices are employed in fuel tanks. These can have a reservoir pot for accumulating fuel and a delivery device, such as an electric fuel pump (EFP), for delivering fuel to the combustion engine. It is furthermore possible to provide an ejector pump (EP) on the fuel delivery device to ensure that the reservoir pot is filled with fuel. Ejector pumps with different characteristics must be supplied for different fuel tanks.

SUMMARY OF THE INVENTION

There may therefore be a requirement for an improved ejector pump which is matched to the requirements of different fuel tanks and of different fuel delivery devices and which combines different characteristics.

Features, details and possible advantages of a device according to embodiments of the invention are discussed in detail below.

According to a first aspect of the invention, a modular ejector pump for a fuel delivery device is presented. The ejector pump has a feed line, a first nozzle and a second nozzle. The feed line is embodied to supply fuel both to the first nozzle and to the second nozzle. The second nozzle is arranged parallel to the first nozzle.

In other words, the concept of the present invention is based on configuring an ejector pump with two separate nozzles which are both supplied with fuel via the same feed line. In this way, the modular ejector pump can combine different characteristics and, at the same time, meet different requirements. For example, the first and the second nozzle can have different diameters, with the result that, with the same pressure in the feed line, a high vacuum is formed at the outlet of the first nozzle and a powerful suction flow is formed at the outlet of the second nozzle, for example. Moreover, the modular ejector pump can have variable or exchangeable component parts, thus making it possible to install the required component parts in the ejector pump according to the requirements of the respective fuel tank.

At the same time, the ejector pump is of modular design. That is to say that the ejector pump can have variable component parts, which can be combined with one another. The ejector pump can furthermore be embodied for retrofitting. For example, the second nozzle, having a first diameter, can be replaced by a second nozzle, having a second diameter. In this way, the diameter of the second nozzle can be matched to the respective fuel delivery device. For example, the second nozzle can be connected to a bubble section and the diameter of the nozzle can be matched to this application. In the case of an application which does not involve a bubble section, the second nozzle can furthermore be closed by an attachment, for example. Moreover, the modular embodiment of the ejector pump allows use both in a conventional fuel tank and in a saddle tank. When the ejector pump is installed in a saddle tank, an outlet line can be arranged between the feed line and the second nozzle, for example, to supply working fluid or fuel to another ejector pump. In this case, the other ejector pump can be arranged in the passive half of the saddle tank. When the ejector pump is used in a simple tank, i.e. in a fuel tank without a passive side, the second nozzle can be embodied in such a way that the outlet line is closed, for example.

The feed line, which is also referred to as the working medium line, can be supplied with fuel by means of an electric fuel pump, for example. Via the feed line, working medium, i.e. fuel, is fed to the ejector pump. The fuel passes via the feed line to the first nozzle and, via a small opening of the first nozzle, enters a first mixing duct. In the mixing duct, there is a pressure drop which leads to the fuel, particularly in the bottom of the reservoir pot, being sucked towards the inside of the reservoir pot, e.g. via an opening in the fuel delivery device. In this case, a valve can be provided at the opening in the bottom of the reservoir pot. An intake chamber, which is connected to the first mixing duct, can furthermore be provided via the opening.

The feed line furthermore also supplies fuel to the second nozzle. At the second nozzle, the fuel enters a second mixing duct via a small opening, in which duct there is likewise a pressure drop. By means of the vacuum which arises at the outlet of the second nozzle, fuel can be sucked out of a bubble section via a bubble line.

In this case, the first nozzle can be arranged directly on or as close as possible to the bottom of the fuel delivery device or of the reservoir pot, for example. In this case, the longitudinal axis of the first nozzle can be aligned parallel to the bottom of the fuel delivery device or of the fuel tank, for example. The second nozzle is arranged above the first nozzle, i.e. further away from the bottom of the fuel tank or of the fuel delivery device. The longitudinal axis of the second nozzle is aligned parallel to the longitudinal axis of the first nozzle.

According to one illustrative embodiment of the invention, the ejector pump furthermore has a bubble line, which is embodied to connect the ejector pump to a bubble section. In this case, the bubble line is arranged at the outlet of the second nozzle in such a way that fuel is sucked out of the bubble section to the ejector pump during the operation of the ejector pump.

Such an embodiment of the ejector pump may be appropriate for use in fuel tanks with venting devices. Here, the venting devices can be used to equalize the pressure in the fuel tank with the surroundings when refueling or during the operation of the motor vehicle. A bubble section can be provided in the venting device, said section being embodied to collect fuel present in the venting device. An intake port can be provided on the bubble section, for example, to which port the bubble line of the ejector pump is connected by further lines, if appropriate. In this case, the bubble line is arranged at the outlet of the second nozzle. This means that the bubble line can be arranged on the second mixing duct, at the point where a vacuum arises at the second nozzle, for example. The fuel collected in the bubble section is thereby sucked into the fuel delivery device. Together with the bubble line, the second nozzle forms an "auxiliary jet pump".

According to another illustrative embodiment of the invention, the ejector pump furthermore has a check valve on or in the bubble line. The check valve (CV) can also be referred to as a "single way valve" or "nonreturn valve". For example, the check valve can be embodied as a spring-loaded ball valve or as a butterfly valve. Here, the check valve allows fuel flow only from the bubble section toward the ejector pump and the reservoir pot.

According to another illustrative embodiment of the invention, the first nozzle has a first diameter and the second nozzle has a second diameter. Here, the second diameter differs from the first diameter. That is to say, the second diameter can be less than or greater than the first diameter. For example, the second nozzle can have a second diameter of about 0.3 mm at the nozzle opening, while the first nozzle opening has a first diameter of about 0.5 mm.

According to another illustrative embodiment of the invention, the ejector pump furthermore has an outlet line, which is embodied to supply fuel to a further ejector pump. Here, the outlet line is provided between the feed line and the second nozzle. That is to say that the outlet line branches off upstream of the second nozzle and downstream of the feed line, for example. Here, the outlet line is embodied to supply fuel as a working medium to a further ejector pump, which is arranged on a passive side of a saddle tank, for example.

According to another illustrative embodiment of the invention, the feed line, the first nozzle and the second nozzle are embodied integrally. For example, these components of the ejector pump are injection molded in a single process step. For variable use of the ejector pump, attachments can be integrated into the ejector pump, for example. In an application without a bubble line, it is possible, in particular, for the second nozzle to be closed by an attachment. Where the ejector pump is used in a simple tank without a passive tank side, the outlet line can furthermore be closed by an attachment or by a plug.

According to another illustrative embodiment of the invention, the second nozzle is embodied as a separate element. In particular, the second nozzle can be injection molded in a single process step, and the first nozzle and the feed line can be integrally injection molded in a further process step. That is to say that the second nozzle is produced separately. In the case of a separate embodiment of the second nozzle, a diameter of the nozzle or the nozzle opening can be made smaller and more accurate. In this way, a high vacuum can be produced in an optimum manner at the bubble line.

According to another illustrative embodiment of the invention, a seal is provided on the outside of the feed line or on the outer circumference of the feed line. The seal can comprise a flexible material, such as rubber, for example. In this case, the seal can cover the outside of the feed line over an extended flat area or, as an alternative, can be embodied as an O-ring. By virtue of the embodiment of the feed line with a seal, a feed pipe, which is connected to an electric fuel pump for example, can be mounted directly on the feed line and end fluid tightly with the latter. In this case, the feed pipe can, for example, be a corrugated pipe and can be passed to the feed line through the housing of the ejector pump.

According to a second aspect of the invention, a fuel delivery device for delivering fuel to a combustion engine is presented. The fuel delivery device has an ejector pump as described above and a bubble section for collecting fuel at a venting device. Here, a bubble line of the ejector pump is connected to the bubble section. As described above, the fuel delivery device can, for example, have a reservoir pot, a further ejector pump, an electric fuel pump and one or more filters.

According to a third aspect of the invention, a method for producing an ejector pump described above is presented. The method has the following steps: supplying a first nozzle and a feed line; connecting the first nozzle to the feed line in such a way that the feed line is embodied to supply fuel to the first nozzle; supplying a second nozzle and arranging the second nozzle parallel to the first nozzle; connecting the second nozzle to the feed line in such a way that the feed line is embodied to supply fuel to the second nozzle.

BRIEF DESCRIPTION OF THE DRAWINGS

Further features and advantages of the present invention will be apparent to a person skilled in the art from the following description of illustrative embodiments, which are not to be interpreted as restricting the invention however, with reference to the attached drawings, in which.

DETAILED DESCRIPTION

Figure 1:
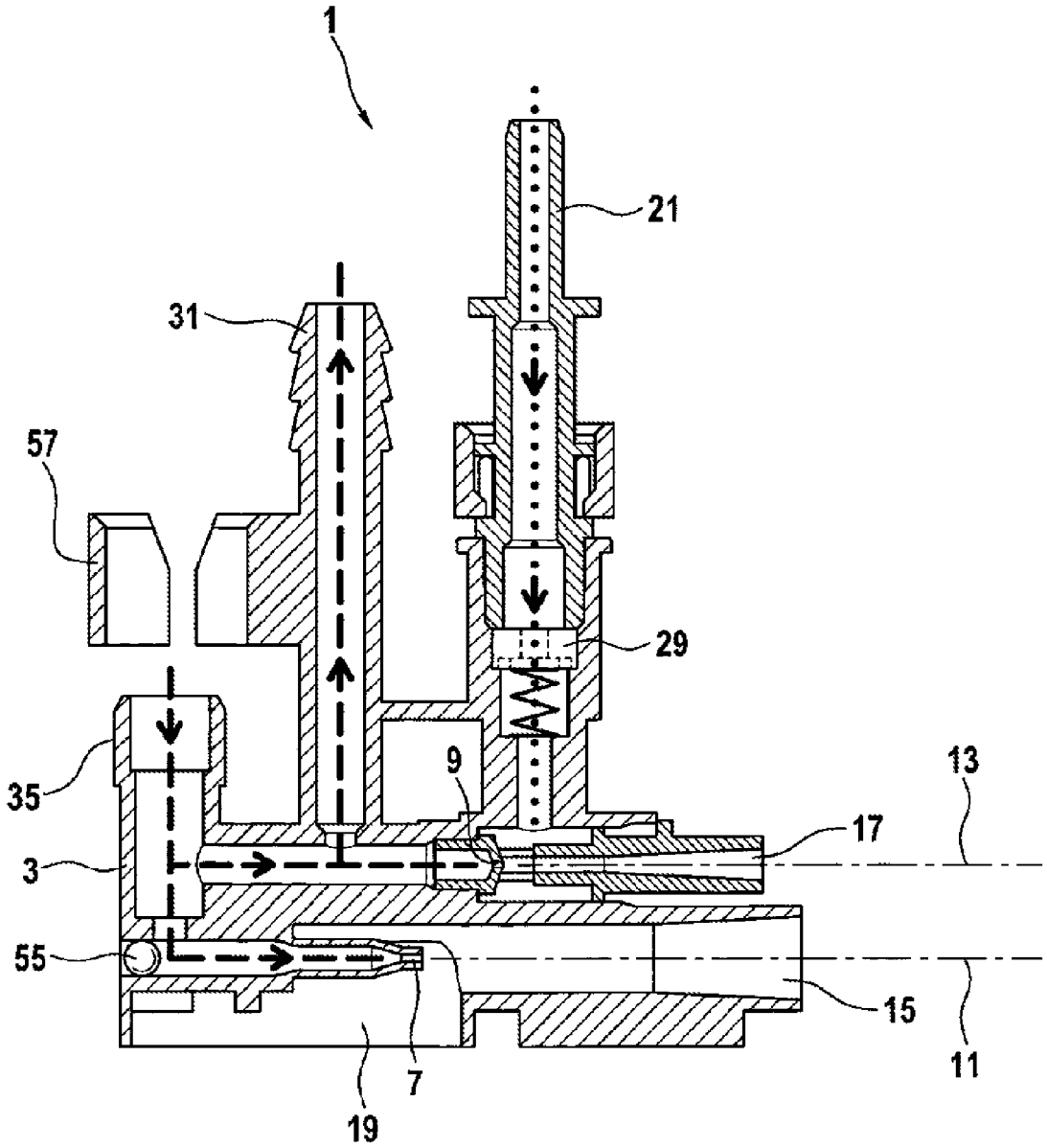
FIG. 1 shows a cross section through a modular ejector pump according to one illustrative embodiment of the invention

All the figures are purely schematic illustrations of devices according to the invention or of components thereof in accordance with the illustrative embodiments of the invention. In particular, spacings and size relationships are not reproduced to scale in the figures. In the various figures, corresponding elements are provided with the same reference numerals.

Figure 3:
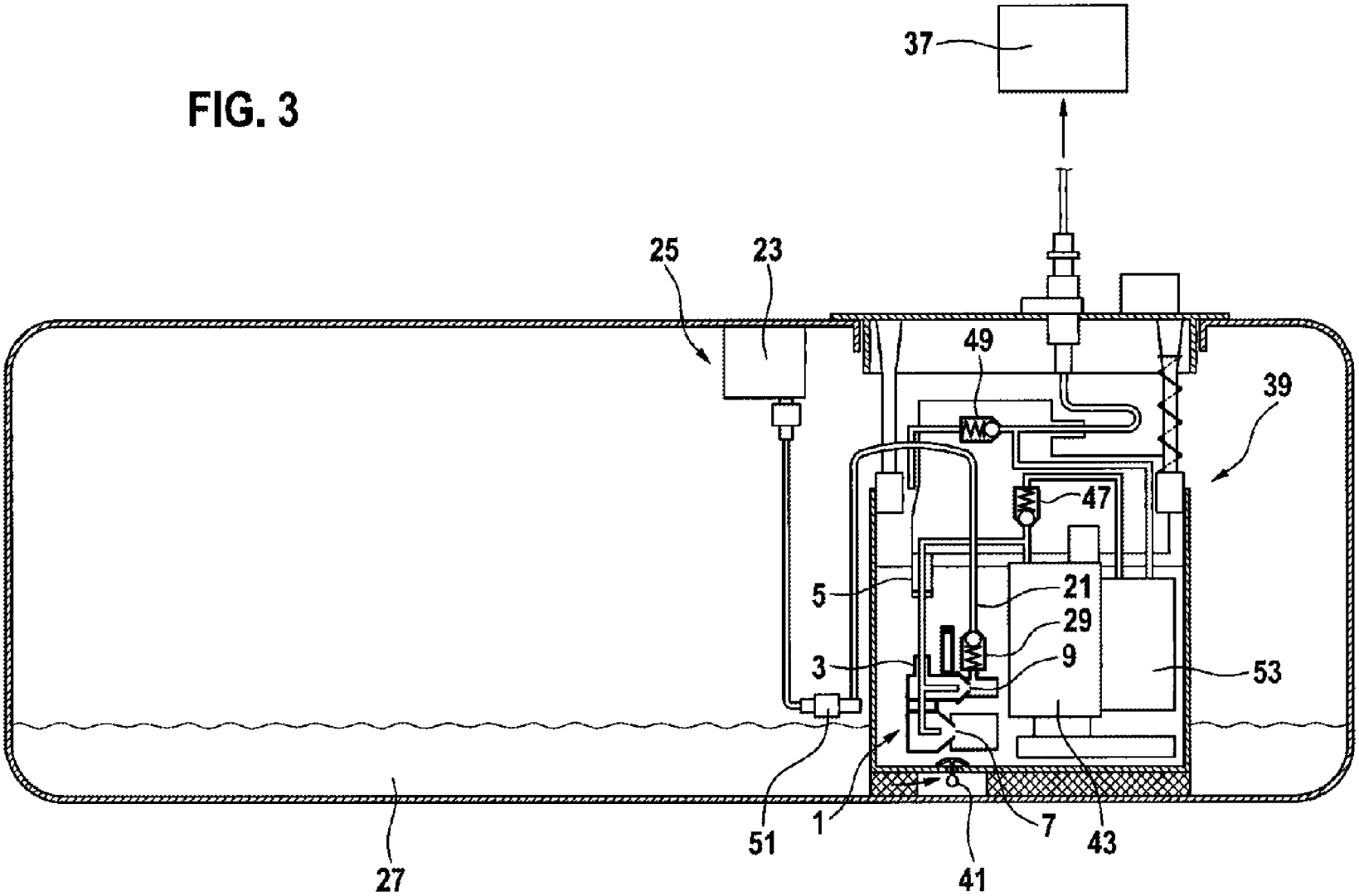
FIG. 3 shows a cross section through a simple tank with a bubble section and a fuel delivery device according to one illustrative embodiment of the invention
Figure 4:
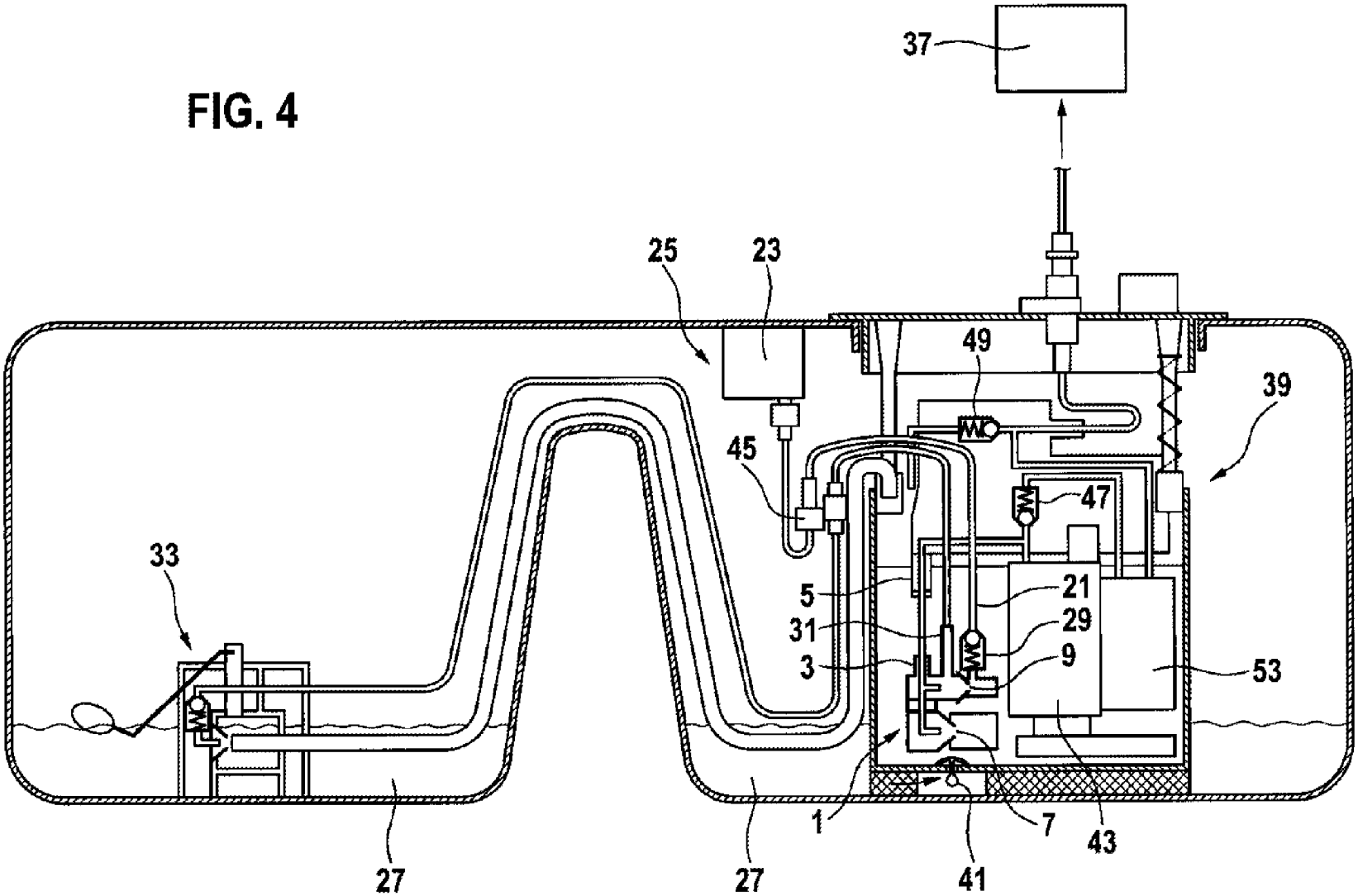
FIG. 4 shows a cross section through a saddle tank with a bubble section and a fuel delivery device according to one illustrative embodiment of the invention
Figure 5:
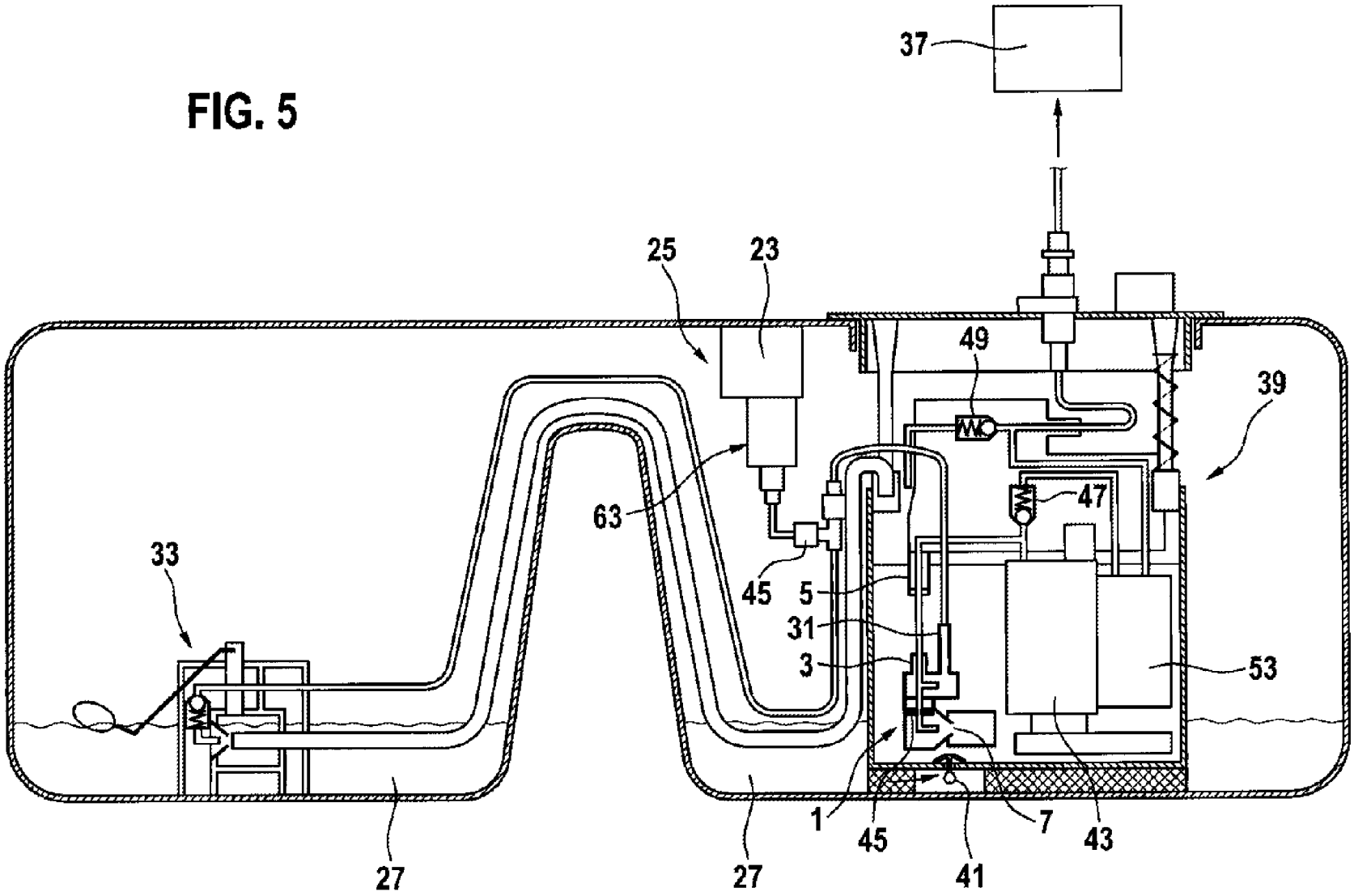
FIG. 5 shows a cross section through a saddle tank with a bubble section and a fuel delivery device according to another illustrative embodiment of the invention

FIG. 1 shows a cross section through a modular ejector pump 1 according to one illustrative embodiment of the invention. The ejector pump 1 has a feed line 3, which can be connected to a feed pipe 5, as illustrated in FIGS. 3 to 5, for example. A seal 35, e.g. a circumferential seal, is provided on the outer circumference of the feed line 3. In this case, the seal 35 can ensure fluidtight sealing between the feed line 3 and a feed pipe 5.

Via the feed line 3, fuel 27 is supplied to a first nozzle 7 and to a second nozzle 9. The longitudinal axis 11 of the first nozzle 7 and the longitudinal axis 13 of the second nozzle 9 are arranged parallel to one another. The housing 57 of the ejector pump 1 can be injection molded, for example. In this case, the feed line 3 and the first nozzle 7 can be formed integrally with the housing 57. In the illustrative embodiment shown, the second nozzle 9 is embodied separately from the housing 57 and hence separately from the first nozzle 7 and the feed line 3. This enables the second nozzle 9 to have a significantly smaller diameter than the first nozzle 7, for example, and hence to produce an optimum vacuum for sucking fuel out of a bubble section 23.

During the injection molding of the ejector pump 1 and, in particular, during the production of the first nozzle 7, an opening can be formed, which is closed by means of a closure cap 55 or a closure ball. The feed line 3 supplies the first nozzle 7 with the working fluid, namely fuel 27. As the fuel 27 emerges from the opening of the first nozzle 7, fuel 27 is entrained or sucked out of the intake chamber 19 into the reservoir pot or into the first mixing duct 15. Here, the intake chamber 19 is provided on the bottom of a reservoir pot, for example.

Moreover, the feed line 3 supplies fuel 27 to the second nozzle 9. As the fuel 27 emerges from the nozzle opening of the second nozzle 9 into the second mixing duct 17, a vacuum arises. In the immediate vicinity of the nozzle opening of the second nozzle 9, a bubble line 21 is provided on the second mixing duct 17. As illustrated, for example, in FIGS. 3 and 4, the bubble line 21 is connected to a bubble section 23. Here, the bubble section 23 can be part of a venting device 25 for equalizing the pressure in a fuel tank with the surroundings, for example. Owing to the vacuum which arises at the nozzle opening of the second nozzle 9, fuel 27 is sucked out of the bubble section 23 to the ejector pump 1 and hence into a reservoir pot. In this case, a check valve 29 is provided in the bubble line 21, preventing a return flow of fuel 27 from the ejector pump 1 to the bubble section 23.

The ejector pump 1 furthermore has an outlet line 31. The outlet line is arranged downstream of the feed line 3 and upstream of the second nozzle 9. The outlet line 31 is embodied to supply fuel 27 as a working medium for a further ejector pump 33, as shown in FIGS. 4 and 5, for example. This is appropriate, for example, in the case of an application in saddle tanks. In this case, the further ejector pump 33 can be arranged in a passive part of the saddle tank.

In FIG. 1, the dashed lines represent an excess pressure zone. The dotted line represents a suction flow of the fuel. Here, the arrows indicate the direction of flow.

Figure 2:
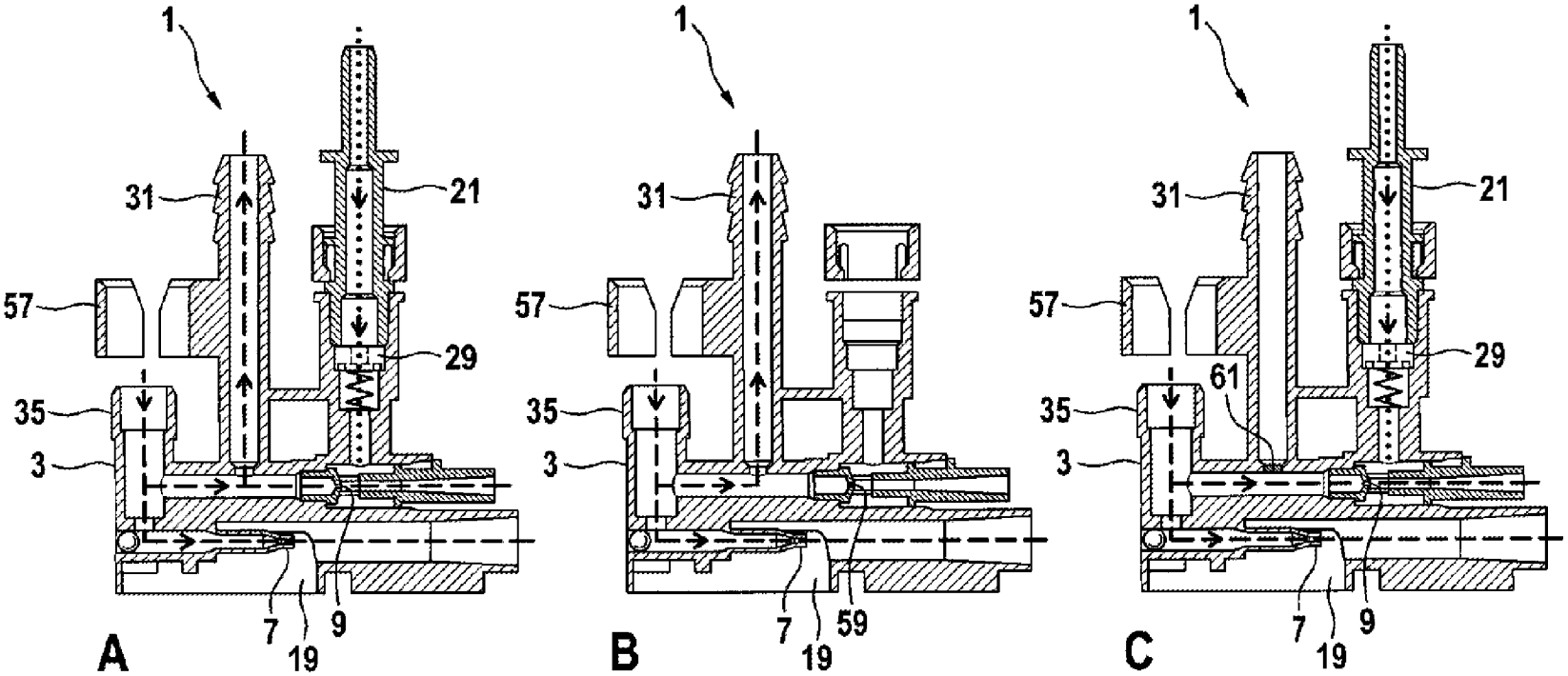
FIG. 2A shows a cross section through a modular ejector pump for use in a saddle tank with a bubble section
FIG. 2B shows a cross section through a modular ejector pump for use in a saddle tank without a bubble section
FIG. 2C shows a cross section through a modular ejector pump for use in a simple tank with a bubble section

FIGS. 2A to 2C show different embodiments of the modular ejector pump 1 in cross section. The ejector pump 1 shown in FIG. 2A can, for example, be installed in a saddle tank with a bubble section 23, as shown in FIG. 4 for example. The ejector pump 1 illustrated in FIG. 2B can be used in a saddle tank without a bubble section 23. Here, the second nozzle 9 of the ejector pump 1 can be closed by means of a plug or of a stopper 59. As an alternative the second nozzle 9 can be embodied without a nozzle opening. In addition, the bubble line 21 can be closed by a closure element. The ejector pump 1 shown in FIG. 2C is suitable for use in a simple tank with a bubble section 23, as shown in FIG. 3, for example. In contrast to the embodiment shown in FIG. 1, the ejector pump 1 in FIG. 2C has a closure element 61 or a closure region on the outlet line 31. It is thus not possible to supply fuel to a further ejector pump 33 in the illustrative embodiment in FIG. 2C, since no further ejector pump 33 is required in the simple tank.

FIG. 3 shows a fuel delivery device 39 in a simple tank or simple fuel tank. The fuel delivery device 39 is installed in the fuel tank by means of a flange and is pressed against the bottom of the fuel tank by means of guide rods and springs, for example. The fuel delivery device 39 has a reservoir pot, which is filled with fuel 27 from the fuel tank via an initial filling valve 41. An electric fuel pump 43 pumps the fuel 27 out of the reservoir pot to a combustion engine 37, e.g. an internal combustion engine. In this case, the electric fuel pump 43 can supply the combustion engine 37 with fuel 27 via a filter 53.

The ejector pump 1 according to the invention is arranged on the bottom or close to the bottom of the fuel delivery device 39. In the illustrative embodiment in FIG. 3, the feed line 3 of the ejector pump 1 is supplied with fuel 27 by means of the electric fuel pump 43. During the operation of the ejector pump 1, the first nozzle 7 allows fuel 27 to be sucked out of the fuel tank through the initial filling valve 41. Moreover, the second nozzle 9 allows fuel 27 to be sucked out of a bubble section 23, which is part of a venting device 25. In this case, a "quick connector" 54, for example, can be provided on a line which connects the bubble line 21 to the bubble section 23. The outlet line 31 is not required in the simple tank and is therefore closed with the aid of a closure element 61, as shown in FIG. 2C.

A return line, in which a pressure limiting valve 49 is arranged, can be provided on a line between the electric fuel pump 43 and the combustion engine 37. A further check valve 47 can furthermore be provided on a line between the electric fuel pump 43 and the filter 53, preventing a return flow of fuel 27 from the filter 53 to the electric fuel pump 43.

FIG. 4 illustrates a fuel delivery device 39 in a saddle tank. In contrast to the illustrative embodiment shown in FIG. 3, the outlet line 31 of the ejector pump 1 is open and is connected to a further ejector pump 33 on the passive side of the fuel tank. In this way, fuel can be delivered to the fuel delivery device 39 both from the passive and from the active side of the saddle tank. In this case, a restrictor 45 can be provided on a line connecting the bubble line 21 and the bubble section 23.

FIG. 5 shows a further illustrative embodiment of a fuel delivery device 39 with an ejector pump 1 for use in a saddle tank with a bubble section 23. In contrast to the illustrative embodiment shown in FIG. 4, no bubble line 21 is provided in FIG. 5. An additional ejector pump 63 is provided directly on the bubble section 23 and is connected via a restrictor 45 to a line connected to the outlet line 31.

Finally, it is pointed out that expressions such as "having" or similar are not intended to exclude the provision of further elements or steps. Moreover, it should be noted that "a" or "an" do not exclude a multiplicity. In addition, features described in connection with the various embodiments can be combined in any desired way. It is furthermore pointed out that the reference signs in the claims should not be interpreted as restricting the scope of the claims.

What is claimed is:

1. A fuel delivery device (39) for delivering fuel (27), the fuel delivery device (39) having an ejector pump (1) including a first passage ending in a first nozzle (7), a second passage ending in a second nozzle (9), the second nozzle (9) being arranged parallel to the first nozzle (7), a feed line (3) that supplies fuel to the first nozzle (7) via the first passage and the second nozzle (9) via the second passage, a bubble line (21), and an outlet line (31), which is configured to supply fuel (27) to a further ejector pump (33), and wherein the outlet line (31) is directly connected to the second passage at a location between the feed line (3) and the second nozzle (9); and a bubble section (23) for collecting fuel (27) at a venting device (25), wherein the bubble line (21) is connected to the bubble section (23), and wherein the first passage and the second passage are independent branches of the feed line (3).

2. The fuel delivery device (39) according to claim 1, furthermore having wherein the bubble line (21) is arranged at an outlet of the second nozzle (9) in such a way that fuel (27) is sucked out of the bubble section (23) to the ejector pump (1) during the operation of the ejector pump (1).

3. The fuel delivery device (39) according to claim 2, wherein a check valve (29) is provided on the bubble line (21); wherein the check valve (29) is configured to prevent return flow of fuel (27) in the direction of the bubble section (23).

4. The fuel delivery device (39) according to claim 1, wherein the first nozzle (7) has a first diameter; wherein the second nozzle (9) has a second diameter; and wherein the second diameter differs from the first diameter.

5. The fuel delivery device (39) according to claim 1, wherein the feed line (3), the first nozzle (7) and the second nozzle (9) are embodied integrally.

6. The fuel delivery device (39) according to claim 1, wherein the second nozzle (9) is embodied as a separate component part.

7. The fuel delivery device (39) according to claim 1, wherein the feed line (3) has a seal (35) on an outside.

8. The fuel delivery device (39) according to claim 1, wherein an end of the outlet line (31) is barbed.

9. The fuel delivery device (39) according to claim 1, further comprising a fuel reservoir, wherein the ejector pump (1) and a fuel pump (43) are arranged in the fuel reservoir, and wherein the fuel (27) collected from the bubble section (23) is transferred to the fuel reservoir.

10. The fuel delivery device (39) according to claim 1, wherein the second passage branches off of the feed line (3) before the first passage.

11. The fuel delivery device (39) according to claim 10, wherein the outlet line (31) branches off of the second passage downstream of where the second passage branches off of the feed line (3).

12. The fuel delivery device (39) according to claim 1, wherein the outlet line (31) branches off of the second passage downstream of where the second passage branches off of the feed line (3).

13. The fuel delivery device (39) according to claim 1, wherein the first passage and the second passage each orthogonally branch from the feed line (3).

14. A method for producing a fuel delivery device (39), the method having the following steps:

supplying a modular ejector pump (1) having a first passage ending in a first nozzle (7), a second passage ending in a second nozzle (9) arranged parallel to the first nozzle, a feed line (3) that supplies fuel to the first nozzle (7) via the first passage and the second nozzle (9) via the second passage, a bubble line (21), and an outlet line (31) that is configured to supply fuel (27) to a further ejector pump (33) and that is directly connected to the second passage at a location between the feed line (3) and the second nozzle (9), wherein the first passage and the second passage are independent branches of the feed line (3);

supplying a bubble section (23) for collecting fuel at a venting device (25); and connecting the bubble line (21) to the bubble section (23).

* * * * *